US007976136B2

(12) United States Patent
Koseki

(10) Patent No.: US 7,976,136 B2
(45) Date of Patent: Jul. 12, 2011

(54) HEAD CHIP, LIQUID JET HEAD, AND LIQUID JET DEVICE

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 209 days.

(21) Appl. No.: 12/455,557

(22) Filed: Jun. 3, 2009

(65) Prior Publication Data

US 2009/0309935 A1 Dec. 17, 2009

(30) Foreign Application Priority Data

Jun. 10, 2008 (JP) ..... 2008-151357

(51) Int. Cl.
*B41J 2/045* (2006.01)

(52) U.S. Cl. ..... 347/71

(58) Field of Classification Search ..... 347/71, 347/70, 68–69, 47, 49; 400/124.14, 124.16; 310/311, 324, 327
See application file for complete search history.

(56) References Cited

U.S. PATENT DOCUMENTS

| | | | | |
|---|---|---|---|---|
| 5,439,728 | A * | 8/1995 | Morozumi et al. | 347/47 |
| 6,079,810 | A | 6/2000 | Davis | 347/47 |
| 7,316,469 | B2 * | 1/2008 | Chikamoto et al. | 347/68 |
| 7,669,982 | B2 * | 3/2010 | Ito | 347/68 |

FOREIGN PATENT DOCUMENTS

| | | |
|---|---|---|
| EP | 1493579 | 1/2005 |
| EP | 1679194 | 7/2006 |
| JP | 03297651 | 12/1991 |
| JP | 04247944 | 3/1992 |
| JP | 2003025570 | 1/2003 |
| WO | 00 26033 | 5/2000 |
| WO | 2006053799 | 5/2006 |

* cited by examiner

*Primary Examiner* — K. Feggins
(74) *Attorney, Agent, or Firm* — Adams & Wilks

(57) ABSTRACT

To prevent an adhesive from flowing into nozzles, there is provided a head chip includes: a plate having a plurality of grooves; a cover plate having an introduction aperture; a nozzle plate fixed to an end surface of the plate, and has nozzles formed at the same intervals; and escape holes formed between the nozzle plate and the plate, each have a contour which surrounds a periphery of each of the nozzles with the contour being spaced apart from a contour of each of the nozzles by at least a given distance, accumulate the adhesive remaining at a time of fixing the nozzle plate therein, and allow the nozzles and the grooves to communicate with each other. The nozzles and the escape holes are so arranged as to be displaced from adjacent nozzles and adjacent escape holes by a given distance in a vertical direction of the nozzle plate.

8 Claims, 10 Drawing Sheets

HEAD CHIP, LIQUID JET HEAD, AND LIQUID JET DEVICE

BACKGROUND OF THE INVENTION

1. Field of the Invention

The present invention relates to a head chip that ejects liquid from a nozzle opening to record an image or a character on a recording medium, a liquid jet head having the head chip, and a liquid jet device having the liquid jet head.

2. Description of the Related Art

At present, as one of liquid jet device, there has been provided an ink jet type recording device that ejects ink (liquid) on a recording medium such as recording paper for recording an image or a character thereon. The recording device is, for example, a printer, a facsimile machine, and so on. The recording device supplies ink to an ink jet head from an ink tank through an ink supply pipe, and ejects ink onto the recording medium from a nozzle opening of the ink jet head, thereby performing the recording.

In general, as illustrated in FIGS. 12 and 13, the ink jet head is equipped with a head chip 100 including an actuator plate 101, a cover plate 102, a nozzle plate 103, and a support plate 104.

The actuator plate 101 is a plate made of a piezoelectric material, and has a plurality of grooves 111 partitioned by side walls 110, respectively. The grooves 111 function as channels into which ink flows to be accumulated. Plate-like drive electrodes (not shown) are formed on both side walls 110 of each groove 111 along the longitudinal direction thereof by vapor deposition. A drive voltage is applied to the drive electrodes.

The cover plate 102 is stacked on an upper surface of the actuator plate 101, and shields the plurality of grooves 111. An ink introduction aperture 102*a* into which ink is introduced is recessed in the cover plate 102. With the configuration, ink is introduced into the plurality of grooves 111.

The actuator plate 101 and the cover plate 102 which are stacked on each other are supported by the support plate 104 in a state where those plates 101 and 102 are fitted into a fitting aperture 104*a* of the support plate 104. In this situation, an end surface of the support plate 104 is flush with end surfaces of the actuator plate 101 and the cover plate 102.

The nozzle plate 103 is in the form of a plate, and fixed to the end surfaces of the support plate 104, the actuator plate 101, and the cover plate 102 with an adhesive S. The adhesive S is omitted from FIGS. 12 and 13.

The nozzle plate 103 has a plurality of nozzle openings 103*a* formed at given intervals. In this case, the plurality of nozzle openings 103*a* are formed to communicate with the plurality of grooves 111, respectively. That is, the nozzle openings 103*a* are formed at the same intervals as the pitches of the grooves 111.

Further, it is general that each nozzle opening 103*a* is formed with a tapered cross section where the diameter of an inlet on the groove 111 side is larger than the diameter of an outlet on the recording medium side.

When ink is ejected from the ink jet head having the head chip 100 thus configured, ink is first supplied into the plurality of grooves 111 through the ink introduction aperture 102*a*, and filled therein in advance. Then, a drive voltage is applied to the drive electrodes. As a result, the side walls 110 of the actuator plate 101 are deformed due to the piezoelectric thickness-shear effect. The deformation of the side walls 110 and the drive method are described in more detail. First, the side walls 110 on both sides of each groove 111 from which ink is ejected are so deformed as to project toward the groove 111 sides adjacent to the ejecting groove 111. That is, the ejecting groove 111 is deformed as if the ejecting groove 111 were swelled. Then, the volume of the ejecting groove 111 increases, and hence ink is led into the groove 111 from the ink introduction aperture 102*a*. After ink has been led into the ejecting groove 111, the drive voltage applied to the drive electrodes is set to zero. As a result, the volume of the groove 111 which has increased once returns to its original volume. Through the above-mentioned operation, an inner pressure of the ejecting groove 111 increases to pressurize ink. As a result, a drop of ink, that is, ink droplet can be ejected from the nozzle opening 103*a*.

Incidentally, in order to perform more downsizing and higher image quality, future head chips are expected to have narrower intervals (pitches) between the grooves 111. Specifically, it is desirable that the existing design with horizontal width of the grooves 111 of about 70 to 80 μm and horizontal width of the side walls 110 of about 60 to 70 μm be narrowed to a design with horizontal width of the grooves 111 of about 40 μm and horizontal width of the side walls 110 of about 30 μm for narrowing the pitches.

In the size of the nozzle openings 103*a*, currently, the inlet diameter is 50 to 55 μm, and the outlet diameter is 20 to 40 μm. Even if the pitches are to be narrowed, it is difficult to further reduce the above-mentioned size in order to ensure the ejecting performance of ink. For that reason, as illustrated in FIG. 14, when the pitches are to be narrowed, the inlet diameter of the nozzle opening 103*a* becomes larger than the horizontal width of the groove 111.

When the pitches are to be narrowed in the conventional head chip, there arise the following disadvantages.

In normally assembling the head chip 100, the nozzle plate 103 is bonded to the support plate 104, the actuator plate 101, and the cover plate 102 which are coated with the adhesive S. For that reason, in bonding those members, there arises a disadvantage that the adhesive S is caused to flow into the nozzle openings 103*a*, and blocks a part of the nozzle openings 103*a*.

In particular, with the inlet diameter of the nozzle openings 103*a* being larger than the horizontal width of the grooves 111 as described above, the adhesive S is liable to flow into the nozzle openings 103*a* as illustrated in FIGS. 15 and 16. Thus, the probability that the nozzle openings 103*a* are blocked is high.

When a part of the nozzle openings 103*a* is thus blocked by inflow of the adhesive S, ejection failure in which ink cannot be normally ejected is induced. For that reason, it is desirable to take some countermeasures so as to prevent the above-mentioned disadvantages.

Under the above-mentioned circumstances, as one of the countermeasures, there has been known a method of stepping the adhesive for adhesion of the nozzle plate (JP 05-330061 A). In the method, the nozzle openings are formed in the nozzle plate having an adhesive surface coated with the adhesive in advance. Then, the adhesive around the nozzle openings is concentrically removed with a diameter larger than the diameter of the nozzle openings.

As another countermeasure, there has been known a method of forming a plurality of grooves for complementing a surplus of the adhesive around the nozzle openings when the nozzle openings are formed in the nozzle plate (JP 07-117230 A).

However, the conventional method still suffers from the following disadvantages.

First, according to the method of stepping the adhesive, it is conceivable to prevent the adhesive from flowing into the nozzle openings. However, it is difficult to find out a suitable adhesive for the stepping method. That is, the adhesive of this type is required to provide at least an adhesion property for firmly adhering to the nozzle plate, a shaping property for executing the stepping process, and ink resistance. However, it is difficult to actually find out the adhesive having those various properties, which makes the method unviable.

On the other hand, according to the method of forming a plurality of grooves for complementing a surplus of the adhesive around the nozzle openings, the surplus adhesive can be indeed pulled into the grooves. However, the adhesive coated at positions close to the nozzle openings is still caused to flow into the nozzle openings. Further, when the surplus adhesive fills the grooves, and the remaining surplus adhesive cannot be complemented by the grooves, the surplus adhesive is still caused to flow into the nozzle openings. For that reason, the amount of inflow adhesive can be indeed reduced, but inflow per se cannot be prevented. Accordingly, the possibility that the ejection failure is induced still remains.

Further, there is conceivable a technique in which, for the purpose of preventing the surplus adhesive from being contained, the adhesive having the amount smaller than the amount for sufficient adhesion is coated to allow the nozzle plate 103 to adhere to a joining body formed of the actuator plate 101 and the cover plate 102. However, when the above-mentioned technique is applied, there is the fear that the adhesion is insufficient. When the adhesion is insufficient, the following disadvantages may occur.

For example, in the case where the adhesion is insufficient, when the nozzle plate 103 is cleaned up by a cleaning member such as a wiper (not shown), there is a risk that the nozzle plate 103 may be peeled off the above-mentioned joining body. Further, when the adhesion is insufficient, there is a risk that an unwanted gap may be formed between the nozzle plate 103 and the joining body, whereby the ink led to the ejecting groove 111 is leaked out of the gap.

In this way, when the adhesive is insufficient, the fear may arise that the above-mentioned disadvantages occur. Therefore, it is essential to apply the sufficient amount of adhesive, and it is necessary to allow the nozzle plate 103 to surely adhere to the joining body. Accordingly, there arises the above-mentioned problem which is resulting from the adhesive.

SUMMARY OF THE INVENTION

The present invention has been made in view of the above-mentioned circumstances, and has an object to provide a head chip, a liquid jet head, and a liquid jet device, which have a high quality and are capable of achieving narrower pitches, and effectively preventing an adhesive from flowing into nozzle openings with a simple configuration to incur no ejection failure.

The present invention provides the following means for solving the above-mentioned problems.

A head chip according to the present invention ejects liquid toward a recording medium, and includes: an actuator plate having a plurality of grooves to be filled with the liquid, formed at given intervals in a horizontal width direction; a drive electrode which is formed on each side wall of each of the plurality of grooves, increases pressure within each of the plurality of grooves by deforming the side wall when a drive voltage is applied to the drive electrode, and causes the filled liquid to be ejected from an inside of each of the plurality of grooves; a cover plate which is stacked on the actuator plate, and has an introduction aperture from which the liquid is introduced into the plurality of grooves; a nozzle plate which is fixed to an end surface of the actuator plate through an adhesive, and has a plurality of nozzle openings formed at the same intervals as intervals of the plurality of grooves in the horizontal width direction; and a number of escape holes which are formed between the nozzle plate and the actuator plate and allow the plurality of nozzle openings and the plurality of grooves to communicate with each other, the number corresponding to a number of the plurality of nozzle openings, in which each of the plurality of escape holes has a contour which surrounds a periphery of each of the plurality of nozzle openings with the contour being spaced apart from a contour of each of the plurality of nozzle openings by at least a given distance, in which the adhesive remaining at a time of fixing the nozzle plate is accumulated in the plurality of escape holes, and in which the plurality of nozzle openings and the plurality of escape holes are so arranged as to be displaced from adjacent nozzle openings and adjacent escape holes by a given distance in a vertical width direction of the nozzle plate, which is orthogonal to the horizontal width direction.

In the head chip according to the present invention, the plurality of grooves formed in the actuator plate are filled with liquid through the introduction aperture formed in the cover plate. In this configuration, when a drive voltage is applied to the drive electrodes, the side walls of the grooves are deformed due to a piezoelectric thickness-shear effect. As a result, the volume in the grooves is reduced to increase a pressure, and the filled liquid is ejected from the inside of the grooves. Then, the ejected liquid is ejected to the outside after having passed through the nozzle openings which communicate with each other through the escape holes. Moreover, when passing through the nozzle openings, the liquid becomes a drop shape, that is, a droplet, and is ejected. As a result, a character, an image, or the like can be recorded on the recording medium.

Incidentally, in assembling the head chip, it is necessary to fix the nozzle plate to the end surface of the actuator plate through the adhesive. In this situation, a number of the escape holes into which the surplus adhesive is escaped and accumulated are disposed between the nozzle plate and the actuator plate so as to correspond the number of the nozzle openings. Moreover, each escape hole is so formed as to surround the periphery of each nozzle opening in a state where the contour of the escape hole is spaced apart at least a given distance from the contour of the nozzle opening.

Accordingly, at the time of adhering to the nozzle plate, even if the surplus adhesive is spread, the surplus adhesive can be allowed to enter the escape holes and be accumulated in the escape holes before arriving at the nozzle openings. For that reason, the adhesive is prevented from flowing into the nozzle openings to block the nozzle openings, and hence the ejection failure can be prevented. In particular, each escape hole is formed such that the contour of the escape hole is spaced apart at least a given distance from the contour of the nozzle opening irrespective of a shape of the nozzle opening, and hence the escaped adhesive can be surely accumulated in the escape hole. Hence, the ejection failure can be effectively prevented.

From the above-mentioned viewpoints, there can be provided the high-quality head chip that causes no ejection failure. Further, with such a simple configuration in which only the escape holes are additionally provided, the head chip can be readily assembled, and the yield can be improved to reduce the costs. Further, there can be provided the head chip that is high in the viability.

Further, the plurality of nozzle openings and the plurality of escape holes are not aligned in the horizontal width direction, but so arranged as to be shifted from the adjacent nozzle openings and the adjacent escape holes by a given distance in the vertical width direction of the nozzle plate. That is, the adjacent nozzle openings and the adjacent escape holes are not aligned side by side, respectively, and hence some free space is ensured around the nozzle openings and the escape holes. For that reason, even if the horizontal width of the grooves and the horizontal width of the side walls are shortened more than the conventional one to achieve narrower pitches, it is unnecessary to reduce the size of the nozzle openings, and the same size as that of the conventional one can be maintained. Moreover, with the existence of the escape holes, there is no risk that the adhesive flows into the nozzle openings. From the above-mentioned viewpoints, the narrower pitches of the head chip can be achieved.

In the head chip according to the present invention, the plurality of nozzle openings and the plurality of escape holes are arranged in zigzag in the horizontal width direction so as to be arranged on two lines in parallel at the given distance.

In the head chip according to the present invention, the plurality of nozzle openings and the plurality of escape holes are alternately arranged in zigzag in the horizontal width direction, and arranged in parallel on two lines at a given distance in the vertical width direction orthogonal to the horizontal width direction. In particular, the positions of the nozzle openings are not discrete, but controlled on two lines, and hence control in ejecting liquid is simpler.

In the head chip according to the present invention, each of the plurality of nozzle openings is an opening having the contour forming a circle.

In the head chip according to the present invention, the nozzle openings are circularly formed, and hence liquid can be more straightly ejected in a state where the linearity of the liquid is improved. Accordingly, the quality of the head chip can be more enhanced.

In the head chip according to the present invention, each of the plurality of escape holes is formed into a square having a center that is substantially coincident with a center of each of the plurality of nozzle openings.

In the head chip according to the present invention, the escape holes do not have a complicated configuration but have a simple square configuration, and hence the escape holes can be simply provided. Further, because of the square shape of the escape holes, when the nozzle openings are circular, larger space in which the adhesive is allowed to be accumulated can be ensured at four corners of the escape holes. Accordingly, the adhesive can be more surely prevented from flowing into the nozzle opening side.

In the head chip according to the present invention, the plurality of escape holes are formed in an adhesion plate that is interposed between the nozzle plate and the actuator plate, and fixed to both of the nozzle plate and the actuator plate through the adhesive.

In the head chip according to the present invention, the escape holes can be formed in the adhesion plate, and hence the escape holes with a desired size and shape can be surely obtained. In particular, the escape holes can be easily and surely positioned with respect to the plurality of nozzle openings with only interposition of the adhesion plate, and hence assembling is simpler.

In the head chip according to the present invention, the plurality of grooves have a part that functions as ejection channels which are filled with the liquid and a part that functions as dummy channels which are filled with no liquid, the part that functions as the ejection channels and the part that functions as the dummy channels being alternately arranged, the introduction aperture is formed with slits that introduce the liquid into only grooves in the part that functions as the ejection channels, and the plurality of nozzle openings are so formed as to communicate with only grooves in the part that functions as the ejection channels.

In the head chip according to the present invention, the slit is formed in the introduction aperture, and hence liquid can be introduced into only a groove functioning as the ejection channel among the plurality of grooves. That is, grooves that function as the dummy channels are alternately disposed among the grooves, and the liquid can be introduced into only the grooves that function as the ejection channels. Then, when a voltage is applied to the drive electrodes, the liquid with which the grooves that function as the ejection channel are filled can be ejected through the nozzle openings.

In particular, the plurality of grooves alternately function as the ejection channels, and hence even if liquid having conductivity is used, the drive electrodes formed on the side walls of the grooves that function as the ejection channels and the drive electrodes formed on the side walls of the grooves that function as the dummy channels can be selectively used in a state where those electrodes are electrically isolated from each other without being rendered conductive through the liquid. Accordingly, recording can be surely conducted with the use of an electrically conductive liquid. In addition, the range of choice of available liquid is widened, and hence more value can be added.

A liquid jet head according to the present invention includes: the above-mentioned head chip according to the present invention; supply means for supplying a given amount of the liquid to the introduction aperture; and control means for applying the drive voltage to the drive electrode.

In the liquid jet head according to the present invention, the supply means surely supplies a given amount of liquid to the introduction aperture of the head chip. Then, the drive voltage is appropriately applied to the drive electrodes by the control means, thereby making it possible to eject liquid from the nozzle openings for recording as described above.

In particular, the high-quality head chip that causes no ejection failure is provided, and hence recording can be surely conducted, and higher quality can be achieved likewise. Further, because of the head chip with the narrowed pitches, recording can be conducted with high quality together with achievement of downsizing.

A liquid jet device according to the present invention includes: the above-mentioned liquid jet head according to the present invention; conveying means for conveying the recording medium in a predetermined direction; and moving means for reciprocating the liquid jet head in a direction orthogonal to the predetermined direction in which the recording medium is conveyed.

In the liquid jet device according to the present invention, the moving means reciprocates the liquid jet head in a direction orthogonal to a direction of conveying the recording medium while the conveying means conveys the recording medium in a predetermined direction. As a result, recording can be accurately performed in a desired range of the recording medium. In particular, the high-quality liquid jet head that causes no ejection failure is provided, and hence it is possible to provide higher quality of the liquid jet device per se likewise.

According to the head chip of the present invention, there can be provided a high-quality head chip that can achieve narrower pitches, can effectively prevent inflow of the adhesive into the nozzle openings with a simple configuration, and causes no ejection failure.

According to the liquid jet head and the liquid jet device of the present invention, the above-mentioned head chip is provided, and hence ejection failure caused by inflow of the adhesive can be eliminated, and higher quality can be achieved. By providing the head chip that can achieve the narrower pitches, the higher quality and the downsizing can be achieved.

DETAILED DESCRIPTION OF THE PREFERRED EMBODIMENT

Hereinafter, an embodiment of the present invention is described with reference to FIGS. 1 to 11.

In this embodiment, as an example of a liquid jet device, an ink jet printer 1 that conducts recording by using a nonconductive and nonaqueous ink (liquid) W is described.

Figure 1:
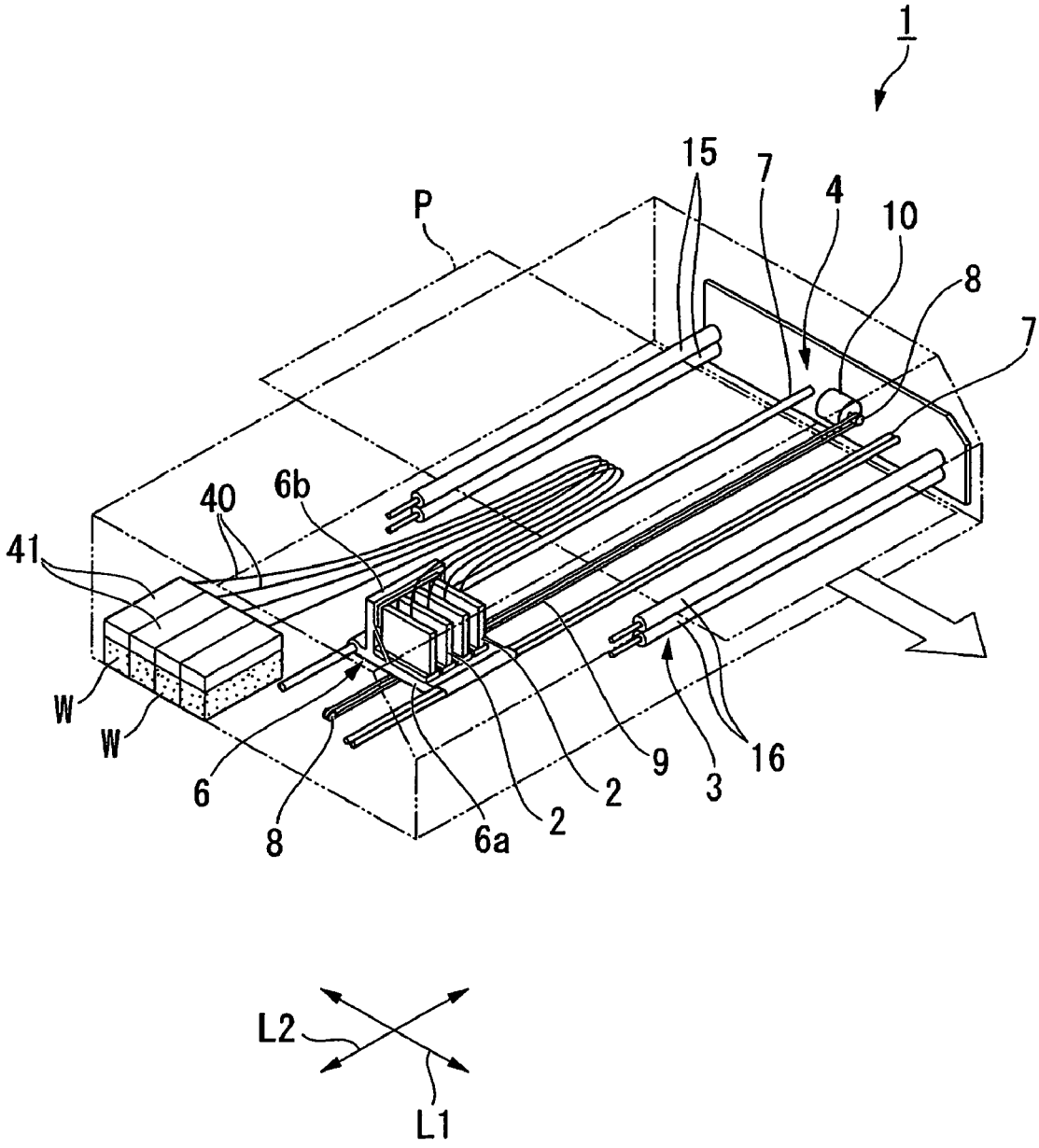
FIG. 1 is a diagram illustrating an ink jet printer which is one embodiment of a liquid jet device according to the present invention.

The ink jet printer 1 according to this embodiment includes, as illustrated in FIG. 1, a plurality of ink jet heads (liquid jet heads) 2 that eject ink W, conveying means 3 for conveying recording paper (recording medium) P in a predetermined conveying direction L1, and moving means 4 for reciprocating the plurality of ink jet heads 2 in an orthogonal direction L2 orthogonal to the conveying direction L1.

That is, the ink jet printer 1 is a so-called shuttle type printer that records characters or images on the recording paper P by moving the ink jet heads 2 in the orthogonal direction 2 orthogonal to the conveying direction L1 while conveying the recording paper P in the conveying direction L1.

In this embodiment, a case in which four ink jet heads 2 that eject the ink W of respectively different colors (for example, black, cyan, magenta, and yellow) are provided is exemplified. Those four ink jet heads 2 are of the same configuration.

Those four ink jet heads 2 are mounted on a carriage 6 incorporated into a substantially rectangular casing 5.

The carriage 6 includes a tabular base 6*a* on which the plurality of ink jet heads 2 are mounted, and a wall 6*b* erected vertically from the base 6*a*. The carriage 6 is reciprocatably supported by guide rails 7 arranged along the orthogonal direction L2. Further, the carriage 6 is coupled with a conveying belt 9 wound around a pair of pulleys 8 in a state where the carriage 6 is supported by the guide rails 7. One of the pair of pulleys 8 is coupled with an output shaft of a motor 10, and rotates upon receiving a rotary drive force from the motor 10. As a result, the carriage 6 can reciprocate in the orthogonal direction L2.

That is, the pair of guide rails 7, the pair of pulleys 8, the conveying belt 9, and the motor 10 function as the moving means 4.

Further, in the casing 5, a pair of carry-in rollers 15 and a pair of conveying rollers 16 are spaced from each other in parallel along the orthogonal direction L2 as in the case of the pair of guide rails 7. The pair of carry-in rollers 15 is disposed on a back side of the casing 5, and the pair of conveying rollers 16 is disposed on a front side of the casing 5. The pair of carry-in rollers 15 and the pair of conveying rollers 16 are rotated by a motor (not shown) while holding the recording paper P therebetween. As a result, the recording paper P can be conveyed along the conveying direction L1 from the back side toward the front side of the casing 5.

That is, the pair of carry-in rollers 15 and the pair of conveying rollers 16 function as the conveying means 3.

Figure 2:
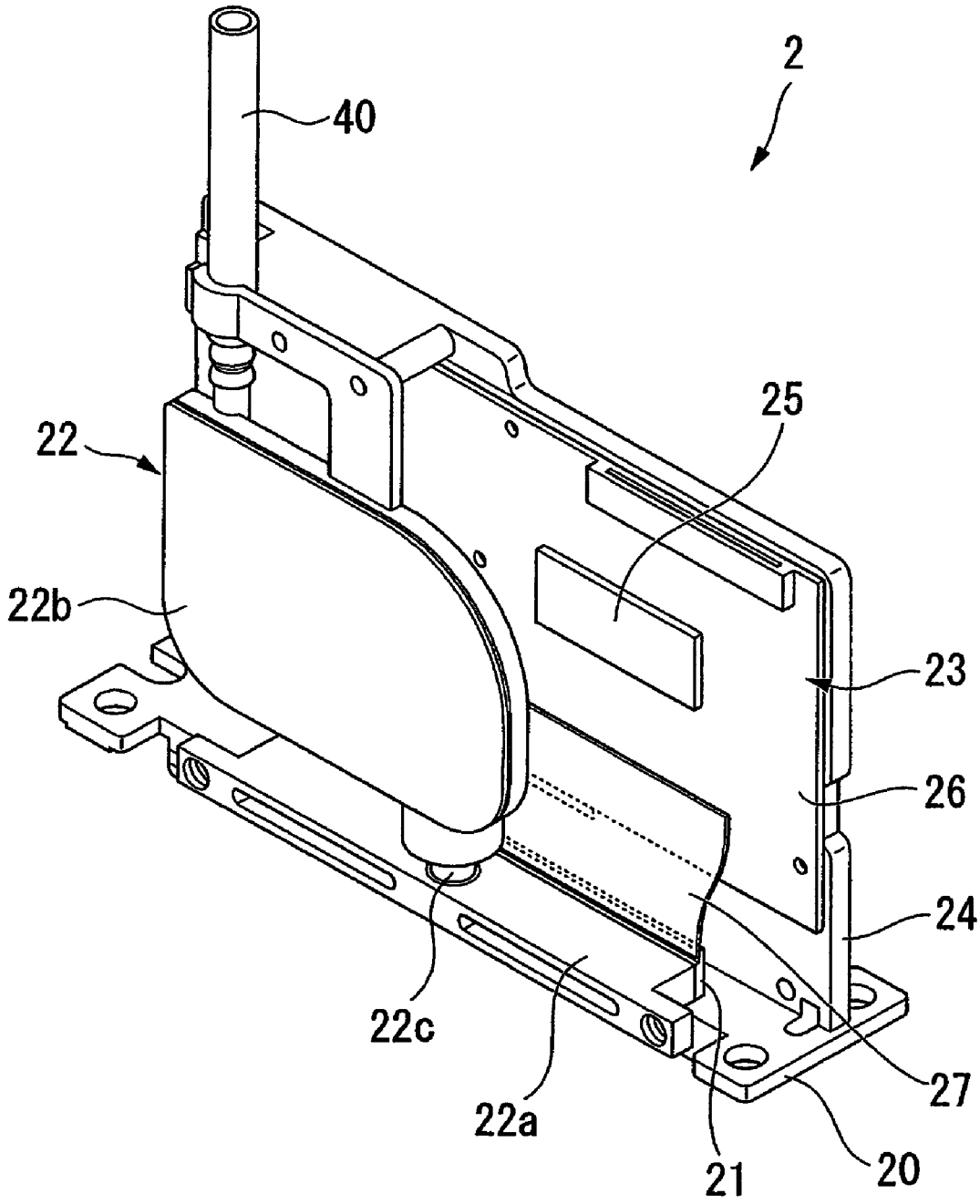
FIG. 2 is an external perspective view of an ink jet head configuring the ink jet printer illustrated in FIG. 1.

As illustrated in FIG. 2, each ink jet head 2 mainly includes a rectangular fixing plate 20 attached to the base 6*a* of the carriage 6 through a screw (not shown), a head chip 21 fixed on an upper surface of the fixing plate 20, supply means 22 for supplying the ink W to an ink introduction aperture 31*a* (described later), of the head chip 21, and control means 23 for applying a drive voltage to drive electrodes 37 described later.

Figure 3:
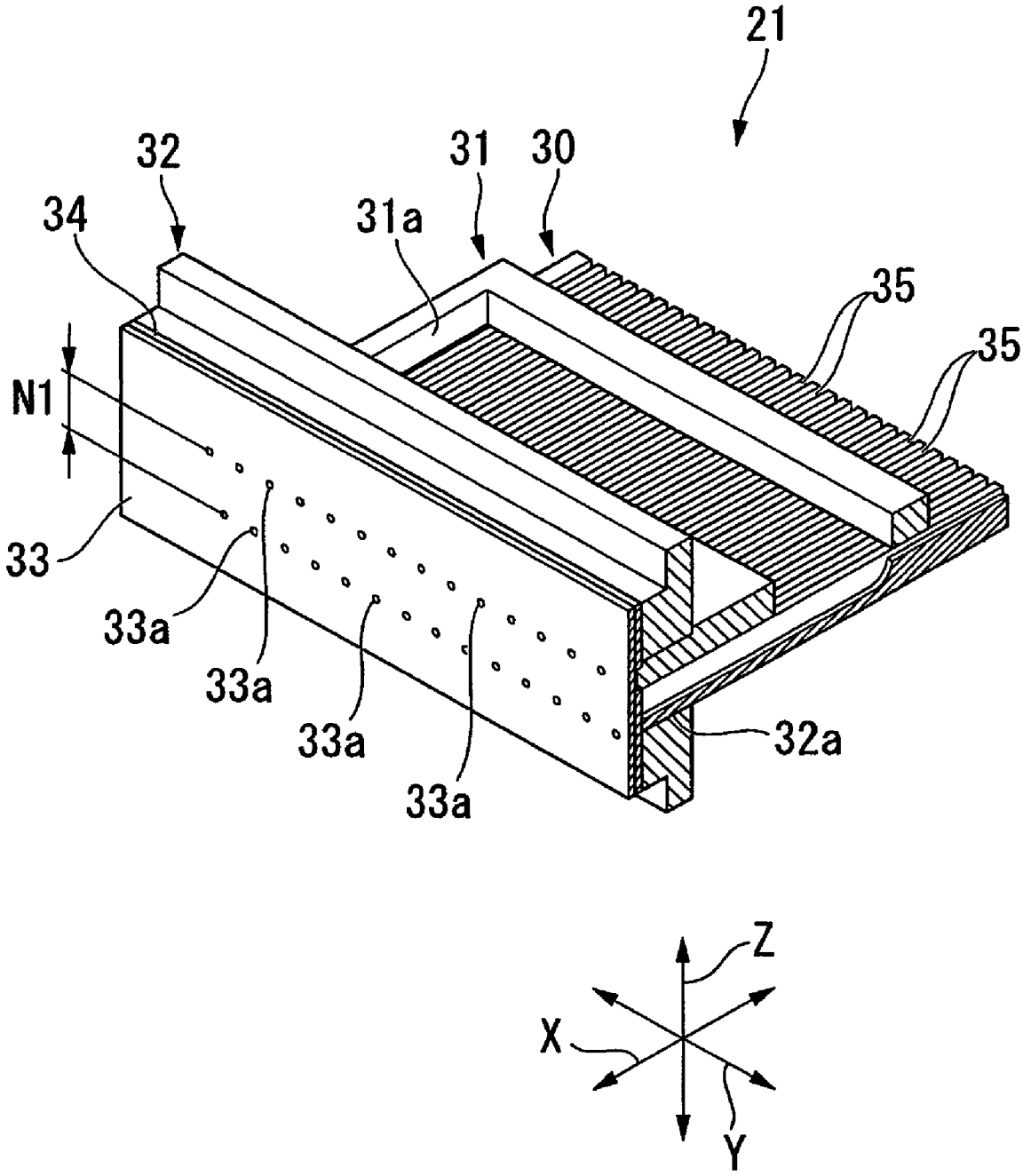
FIG. 3 is a perspective view of a head chip configuring the ink jet head illustrated in FIG. 2.
Figure 4:
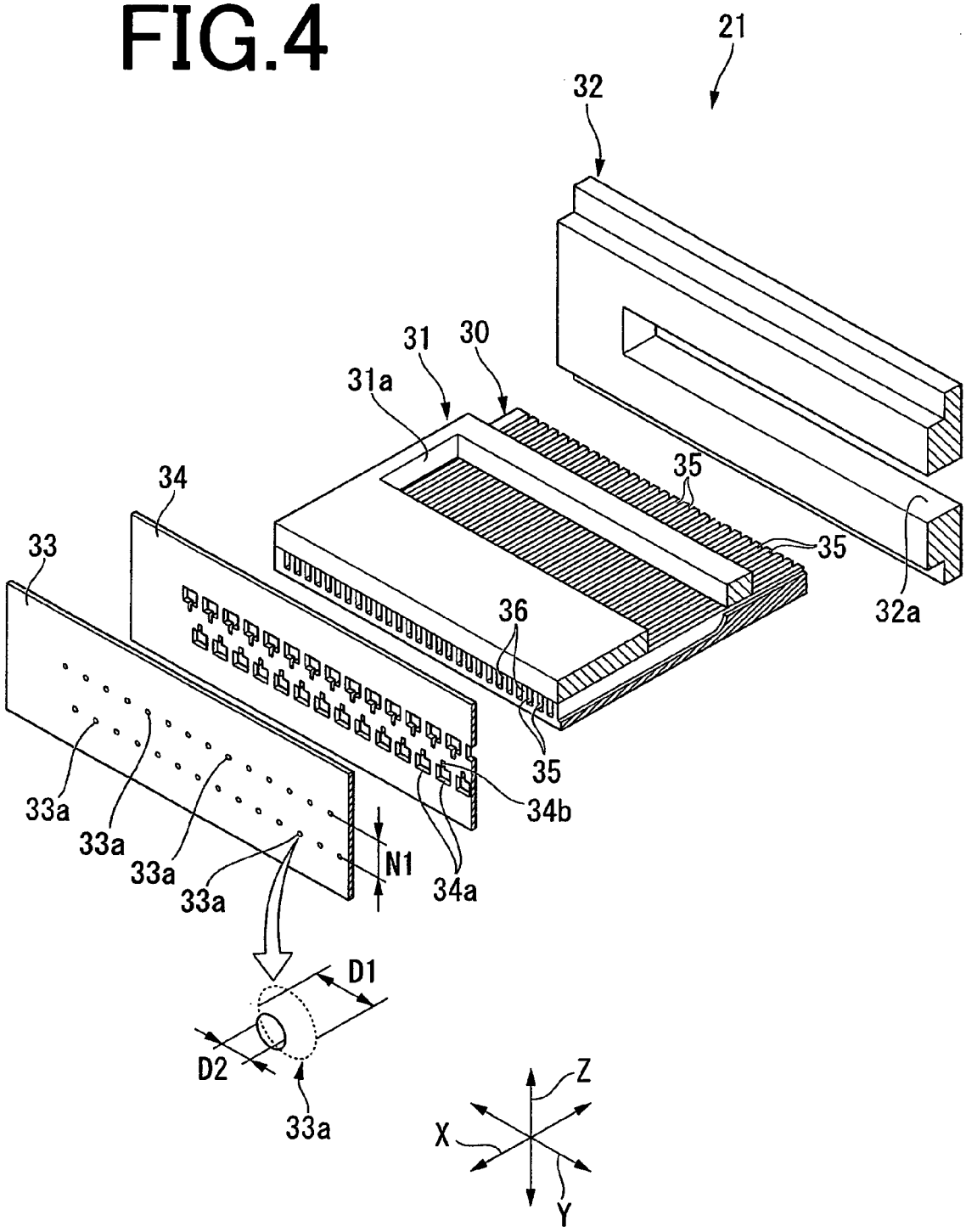
FIG. 4 is an exploded perspective view of the head chip illustrated in FIG. 3.

The head chip 21 mainly includes, as illustrated in FIGS. 3 and 4, an actuator plate 30, a cover plate 31, a support plate 32, a nozzle plate 33, and an adhesion plate 34.

The actuator plate 30 is a plate made of a piezoelectric material such as a lead zirconate titanate (PZT). On an upper surface of the actuator plate 30 are formed a plurality of grooves 35 extending in a longitudinal direction (direction indicated by an arrow X), which are spaced at given intervals in a horizontal width direction (direction indicated by an arrow Y). That is, the plurality of grooves 35 are partitioned by side walls 36, respectively.

The plurality of grooves 35 are so formed as to open on the front end side of the actuator plate 30, and also so formed as to be gradually shallower toward the rear end surface. The rear end surface side of the grooves 35 is sealed with sealing means (not shown). The plurality of grooves function as channels that are filled with the ink W.

Figure 5:
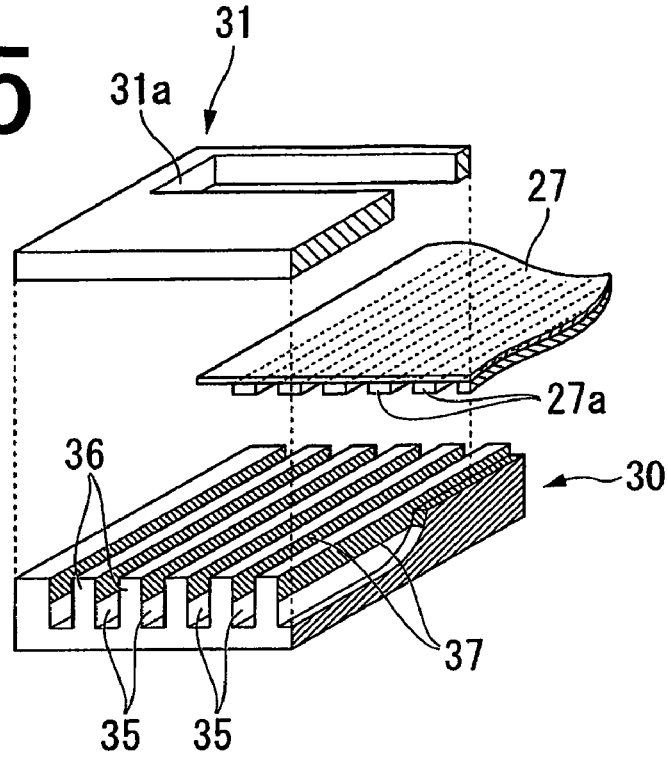
FIG. 5 is an enlarged view of the head chip illustrated in FIG. 3 in a state where an actuator plate and a cover plate are exploded.
Figure 6:
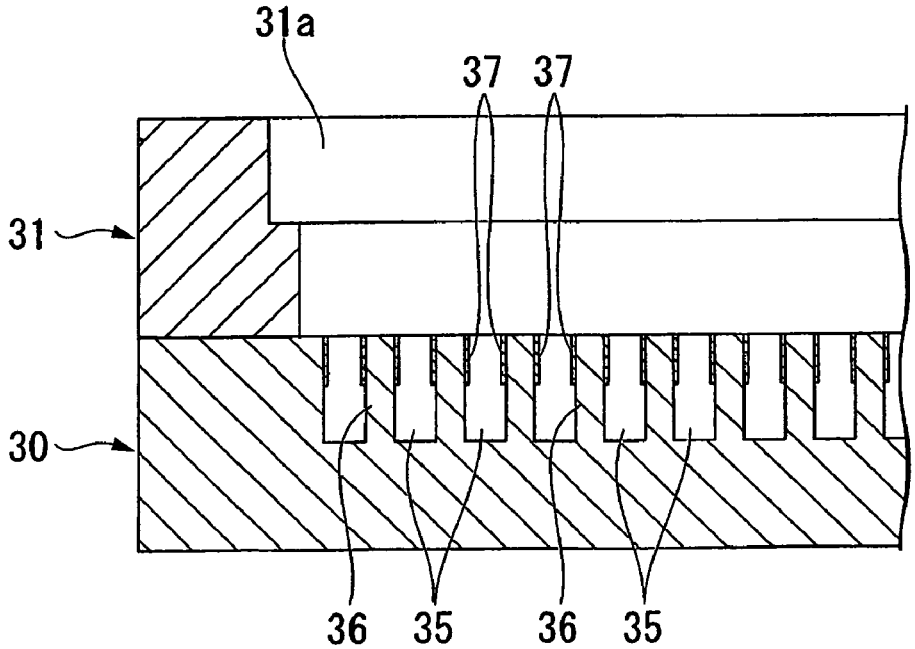
FIG. 6 is a cross-sectional view of a head chip illustrated in FIG. 3.

As illustrated in FIGS. 5 and 6, the side walls 36 of the plurality of grooves 35 are formed with the drive electrodes 37 in the longitudinal direction by deposition or the like. The drive electrodes 37 are electrically joined together on the rear end side of the actuator plate 30 having a depth which becomes shallower within the respective grooves 35. Then, the joined grooves 35 are electrically connected to extraction electrodes 27*a* of a flexible substrate 27 described later.

When the drive voltage is applied to the drive electrodes 37, the drive electrodes 37 functions so that the side walls 36 are deformed by the piezoelectric thickness-shear effect to increase the pressure within the grooves, and that the filled ink W is ejected from the inside of the grooves.

Returning to FIGS. 3 and 4, the cover plate 31 is stacked on the upper surface of the actuator plate 30 in a state where a part of the plurality of grooves 35 is exposed. Further, the ink introduction aperture 31*a* to which the ink W is supplied is formed in the cover plate 31 in the horizontal width direction. With the above-mentioned configuration, the plurality of grooves 35 can be filled with the ink W.

The support plate 32 supports the actuator plate 30 and the cover plate 31 which have been stacked on each other, and also supports the nozzle plate 33 and the adhesion plate 34 at the same time. The support plate 32 is formed with a fitting hole 32*a* in the horizontal width direction, and supports both of the plates 30 and 31 in a state the actuator plate 30 and the cover plate 31 which have been stacked on each other are fitted into the fitting hole 32*a*. In this situation, those plates 30, 31, and 32 are fitted together in such a manner that the end surface of the support plate 32 are flush with the front end surfaces of both the plates 30 and 31.

Then, the nozzle plate 33 is fixedly adhered to the end surface of the support plate 32 and the front end surfaces of both the plates 30 and 31 with the adhesive S in a state where the adhesion plate 34 is interposed therebetween. In FIGS. 3 and 4, the adhesive S is omitted.

The nozzle plate 33 is a sheet-like plate made of a film material such as polyimide, which is about 50 μm in thickness. The nozzle plate 33 has one surface being an adhesion surface adhered to the adhesion plate 34, and another surface being an opposed surface facing the recording paper P. The opposed surface is coated with a water repellent film having water repellency for preventing attachment of the ink W.

Further, a plurality of nozzle openings 33*a* are formed in the nozzle plate 33 at the same intervals as the pitches of the plurality of grooves 35 in the horizontal width direction. In this situation, the nozzle openings 33*a* are aligned in a state where the nozzle openings 33*a* are displaced by a given distance N1 in the vertical width direction (direction indicated by an arrow Z) of the nozzle plate orthogonal to the horizontal width direction, with respect to the adjacent nozzle openings 33*a*.

Figure 7:
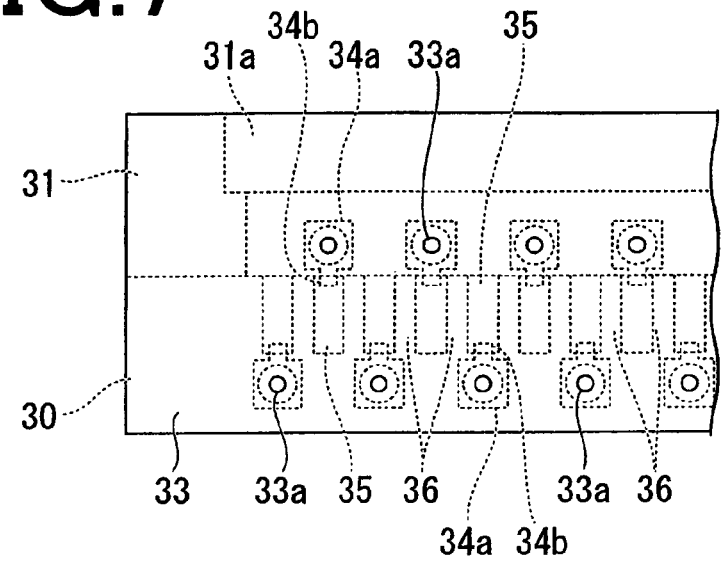
FIG. 7 is a view of the head chip illustrated in FIG. 3 viewed from a nozzle plate side.
Figure 8:
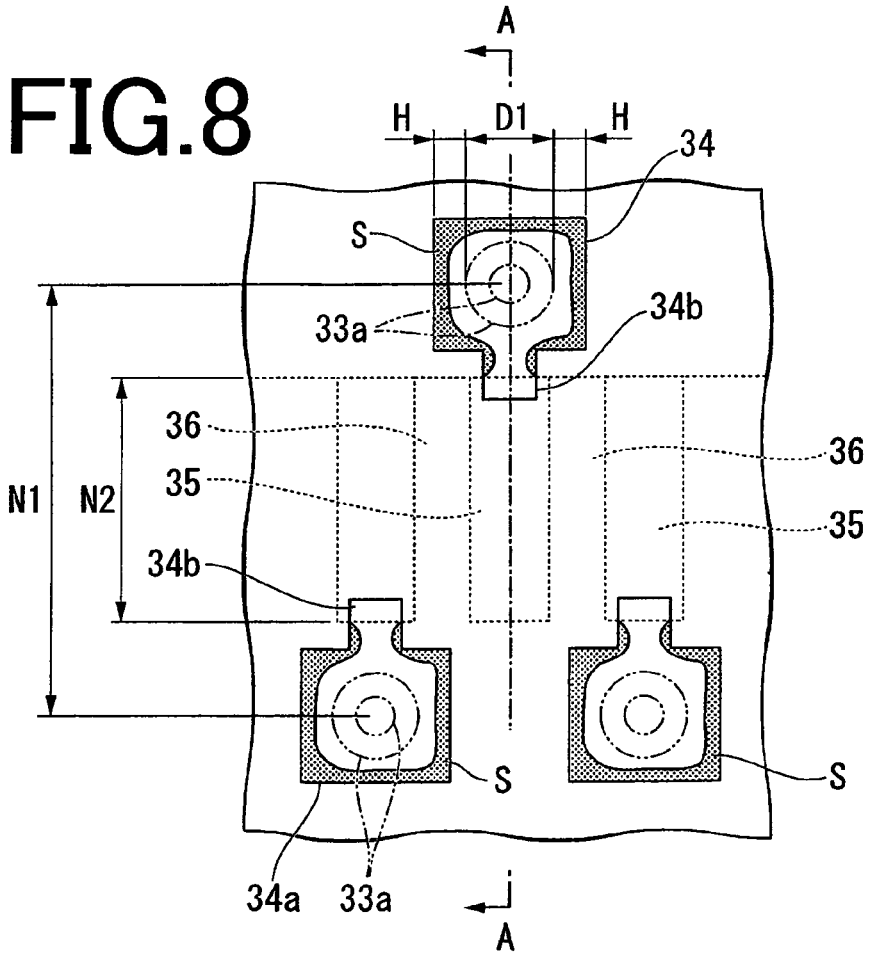
FIG. 8 is an enlarged view of a nozzle opening periphery illustrated in FIG. 7, which illustrates a positional relationship between the nozzle openings and escape holes.

In more detail, the plurality of nozzle openings 33*a* are alternately and arranged in zigzag in the horizontal width direction, and are arranged side by side in parallel on two lines at the given distance N1 in the vertical width direction. Moreover, as illustrated in FIGS. 7 and 8, each of the nozzle openings 33*a* has a center positioned on the horizontal width center line of each groove 35.

In addition, in this embodiment, the above-mentioned given distance N1 is designed to be larger and longer than a horizontal width N2 of the grooves, and the nozzle openings 33*a* and the grooves 35 are not overlapped on a straight line when the nozzle plate 33 is viewed in a planar manner.

Further, each nozzle opening 33*a* is circularly formed so that the contour thereof forms a circle. Moreover, as illustrated in FIG. 4, the nozzle opening 33*a* is tapered in cross section so that an inlet diameter D1 (diameter of contour of nozzle opening 33*a*) on the adhesion surface side is larger than an outlet diameter D2 on the opposed surface side. In particular, the inlet diameter D1 of the nozzle opening 33*a* is larger than the horizontal width of the groove 35.

The nozzle openings 33*a* are formed by using an excimer laser device, or the like.

As illustrated in FIGS. 3 and 4, the adhesion plate 34 is a plate formed with substantially the same thickness and the same size as those of the nozzle plate 33. The adhesion plate 34 is made of, for example, ceramic, polyimide, or the like, but material thereof may be freely selected as long as the material has resistance to the ink W. Further, it is preferable that a material of the adhesion plate 34 have substantially the same thermal deformation characteristic as that of a material used for the joining body of the actuator plate 30 and the cover plate 31 so that the mutual thermal deformation is substantially equal to each other because the adhesion plate 34 is to be adhered to the joining body.

A plurality of escape holes 34*a* are formed in the adhesion plate 34 so as to face the plurality of nozzle openings 33*a*, respectively. That is, the plurality of escape holes 34*a* are formed in zigzag at the same pitches as those of the nozzle openings 33*a* in the horizontal width direction. Moreover, as illustrated in FIG. 8, the escape holes 34*a* are so formed as to surround the peripheries of the nozzle openings 33*a* with their contours being spaced at least a given distance H from the contours of the nozzle openings 33*a*, and the surplus adhesive S can be escaped into the escape holes 34*a* and accumulated therein at the time of fixing the nozzle plate 33.

Figure 9:
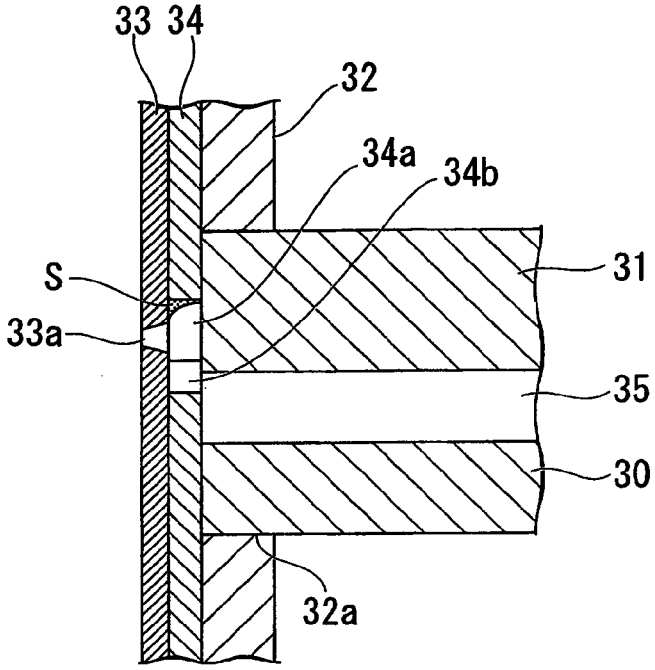
FIG. 9 is a cross-sectional view taken along a line A-A of FIG. 8.

Specifically, each escape hole 34*a* is formed into a square shape having a center which coincides with the center of the nozzle opening 33*a*, and the length of one side is [(inlet diameter D1 of nozzle openings 33*a*)+((above-mentioned given distance H)×2)] Moreover, a part of each escape hole 34*a* is formed with an extended projection 34*b* that projects toward the groove 35, whereby, as illustrated in FIGS. 8 and 9, the nozzle holes 33*a* and the grooves 35 communicate with each other. As a result, the ink W pressurized by the grooves 35 can be ejected toward the external from the nozzle openings 33*a* through the escape holes 34*a*.

As illustrated in FIG. 2, the head chip 21 thus configured is fixed to the upper surface of the fixing plate 20 as described above. To the upper surface of the fixing plate 20 are fixed a rectangular base plate 24 made of aluminum or the like in a vertically erecting state, and a passage member 22*a* that supplies the ink W to the ink introduction aperture 31*a* of the head chip 21. Above the passage member 22*a*, a pressure buffer 22*b* with a reservoir that reserves the ink W therein is so arranged as to be supported by the base plate 24. The pressure buffer 22*b* and the passage member 22*a* are coupled with each other through an ink connecting pipe 22*c*. Further, an upper portion of the upper buffer 22*b* is fitted with a supply tube 40 from which the ink W is supplied.

With the above-mentioned configuration, when the ink W is supplied to the pressure buffer 22*b* through the supply tube 40, the ink W is reserved in the reservoir within the pressure buffer 22*b* once. Then, the pressure buffer 22*b* supplies a given amount of ink W out of the reserved ink W to the ink introduction aperture 31*a* of the head chip 21 through the ink connecting pipe 22*c* and the passage member 22*a*.

That is, the passage member 22*a*, the pressure buffer 22*b*, and the ink connecting pipe 22*c* function as the above-mentioned supply means 22.

As illustrated in FIG. 1, the supply tubes 40 are coupled with ink tanks 41 incorporated into the casing 5, respectively. With the configuration, the inks W different in color which are reserved in the ink tanks 41 are supplied to the four ink jet heads 2, respectively.

Further, as illustrated in FIG. 2, the base plate 24 is fixed with an IC substrate 26 including a driver circuit 25 such as an integrated circuit for driving the head chip 21. The driver circuit 25 and the drive electrodes 37 of the head chip 21 are electrically connected to each other through the flexible substrate 27 on which the plurality of extraction electrodes 27*a* are printed.

As illustrated in FIG. 5, the flexible substrate 27 is connected to the drive electrodes 37 so as to be fitted into the shallower portions of the respective grooves 35. Then, the driver circuit 25 applies the drive voltage to the drive electrodes 37 through the flexible substrate 27, whereby the ink W is ejected.

That is, the driver circuit 25 and the flexible substrate 27 function as the above-mentioned control means 23.

Subsequently, a description is given hereinafter of a case in which a character, a graphic, or the like is recorded on the recording paper P by using the ink jet printer 1 configured as described above.

It is assumed that, in an initial state, the inks W different in color are sufficiently filled in the four ink tanks 41, respectively. Further, the ink W within the ink tank 41 is supplied to the pressure buffer 22*b* through the supply tube 40 due to a hydraulic head difference. For that reason, a given amount of ink W is supplied to the ink introduction aperture 31*a* of the head chip 21 through the ink connecting pipe 22*c* and the passage member 22*a*, and filled within the plurality of grooves 35.

In the above-mentioned initial state, when the ink jet printer 1 is actuated, the pair of carry-in rollers 15 and the pair of conveying rollers 16 rotate and convey the recording paper P toward a conveying direction L1. Further, at the same time, the motor 10 rotates the pulleys 8 to move the conveying belt 9. As a result, the carriage 6 reciprocates in the orthogonal direction L2 while being guided by the guide rails 7. During the operation, the head chips 21 of the respective ink jet heads 2 allow the ink W of four colors to be appropriately ejected onto the recording paper P, thereby enabling a character, an image or the like to be recorded. In particular, because of the shuttle system, recording can be accurately performed in a desired range of the recording paper P.

Now, the motion of the respective ink jet heads 2 is described in more detail below.

Figure 10:
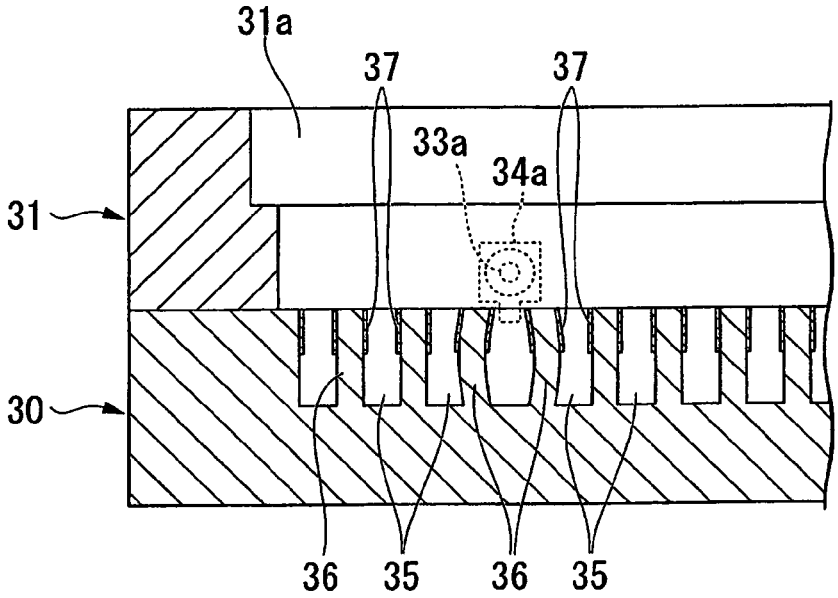
FIG. 10 is a diagram illustrating a state where a drive voltage is applied to drive electrodes from a state illustrated in FIG. 6 to deform side walls.

When the carriage 6 starts to reciprocate, the driver circuit 25 applies the drive voltage to the drive electrodes 37 through the flexible substrate 27. In more detail, as illustrated in FIG. 10, the drive voltage is applied to the drive electrodes 37 disposed on the two side walls 36 at both sides of the groove 35 that ejects the ink W, respectively, and those two side walls 36 are so deformed as to project toward the sides of the grooves 35 adjacent to the groove 35 that ejects the ink W. That is, the two side walls 36 are deformed as if the ejecting groove 35 were swelled. In FIG. 10, a case in which the ink W is ejected from one groove 35 is exemplified.

The volume of the ejecting groove 35 is increased by deformation due to the piezoelectric thickness-shear effect of the two side walls 36. Then, with an increase in the volume of the groove 35, the ink W is led to the groove 35 from the ink introduction aperture 31*a*. Then, at timing when the ink W is led to the groove 35, the drive voltage applied to the drive electrodes 37 is set to zero. As a result, the deformation of the side walls 36 is returned to the original shape, and the volume of the groove 35 that has increased once is returned to the original volume. Through the above-mentioned operation, the pressure in the inside of the ejecting groove 35 increases to pressurize the ink W. As a result, the ink W is ejected from the groove 35.

The drive electrodes 37 described above are so formed as to function, separately, as electrodes for selectively ejecting the ink W from the adjacent grooves 35, respectively. Further, when the ink W needs to be further pressurized in order to stably eject the ink W, the side walls 36 are so deformed as to project toward the ejecting groove 35 side. Through the operation, the pressure in the inside of the ejecting groove 35 is further increased, and therefore the ink W can be further pressurized. The above-mentioned operation is aimed at stably ejecting the ink W as described above, and hence the operation is not essential, and may be appropriately used as occasion demands.

Further, in this embodiment, the nonaqueous ink W is used, and hence the above-mentioned respective operations are executed in combination as occasion demands, thereby making it possible to realize the optimum ejection of the ink W.

The ejected ink W is ejected to the external after having passed through the nozzle openings 33*a* through the extended projections 34*b* of the escape holes. Moreover, the ink W is ejected in a liquid droplet, that is, ink droplet when passing through the nozzle openings 33*a*. As a result, as described above, a character, an image, or the like can be recorded on the recording paper P.

In particular, the nozzle openings 33*a* of this embodiment is tapered in cross section, and hence the ink droplet can be ejected at high speed, straightly, and with the high direct advance property. Hence, recording can be performed with high quality.

Subsequently, a description is given in brief of fixation of the nozzle plate 33 in assembling the head chip 21 configured as described above.

First, prior to the fixation, after the adhesive S has been coated on the front end surfaces of the actuator plate 30 and the cover plate 31, the adhesion plate 34 is brought into contact with the front end surfaces of both the plates 30 and 31 while executing positioning so that the grooves 35 face the escape holes 34*a* and the extended projections 34*b* of the adhesion plate 34, and is then thermally cured. In this situation, it is preferable to use the epoxy-based adhesive S which is cured by heating. Then, after the adhesive S has been coated on the adhesion plate 34, the nozzle plate 33 is brought into contact with the adhesion plate 34 while executing positioning so that the escape holes 34*a* and the nozzle openings 33*a* face each other, and is then thermally cured. Finally, after the adhesive S has been coated on the end surface of the support plate 32, the support plate 32 is pushed against the rear surface of the nozzle plate 33 and then heated so as to be cured. As a result, the head chip 31 illustrated in FIG. 3 can be assembled.

In particular, even if the surplus adhesive S is spread at the time of adhering the nozzle plate 33, the adhesive S can be allowed to enter the escape holes 34*a* and be accumulated therein before arriving at the nozzle openings 33*a* as illustrated in FIGS. 8 and 9. For that reason, the adhesive S is prevented from flowing into the nozzle openings 33*a* to infill the nozzle openings 33*a*, and hence the ejection failure can be prevented. Moreover, the escape holes 34*a* are each formed with a size which enables keeping at least a given distance H from the contour of the nozzle openings 33*a*, and hence the escaped adhesive S can be surely accumulated therein. In addition, the escape holes 34*a* of this embodiment are square, and hence a large space at four corners of the square in which the adhesive S can be accumulated is ensured. Accordingly, the adhesive S can be surely prevented from flowing into the nozzle openings 33*a* side. As a result, the ejection failure caused by inflow of the adhesive S can be effectively prevented.

From the above-mentioned viewpoints, there can be provided the high-quality head chip 21 causing no ejection failure. Further, because of the simple configuration in which only the escape holes 34*a* are additionally provided, the head chip 21 can be readily assembled, the low costs can be achieved with the improved yield, and the head chip 21 high in realizablity can be provided.

Moreover, the plurality of escape holes 34*a* are formed in the adhesion plate 34. Hence, the adhesion plate 34 and the nozzle plate 33 are merely stacked on each other, thereby enabling the escape holes 34*a* to be readily and surely positioned with respect to the plurality of nozzle openings 33*a*. Thus, the assembling is simple.

Further, the plurality of nozzle openings 33*a* and the plurality of escape holes 34*a* are not arranged on a straight line in the horizontal width direction, but are so arranged as to be displaced from the adjacent nozzle openings 33*a* and the adjacent escape holes 34*a* by the given distance N1 in the vertical width direction of the nozzle plate 33. That is, the adjacent nozzle openings 33*a* and the adjacent escape holes 34*a* are not arranged side by side horizontally, and hence a certain degree of free space can be ensured in the surroundings thereof. For that reason, even if the pitches are to be narrowed by making the horizontal width of the grooves 35 and the horizontal width of the side walls 35 shorter than those of the conventional art, the same size as that of the conventional art can be maintained with no need to reduce the size of the nozzle openings 33*a*. Moreover, there is no risk that the adhesive S flows into the nozzle openings 33*a* due to the existence of the escape holes 34*a*. From the above-mentioned viewpoints, the pitches of the head chip 21 can be narrowed.

For example, in the conventional art, the horizontal width of the grooves 35 is 75 μm, the horizontal width of the side walls 36 is 66 μm, and the inlet diameter D1 of the nozzle openings 33*a* is 55 μm. On the other hand, according to this embodiment, even if the pitches are narrowed to the degree that the horizontal width of the grooves 35 is 40 μm, and the horizontal width of the side walls 36 is 30 μm, the inlet diameter D1 of the nozzle openings 33*a* can be kept to 55 μm. In this case, the size of the escape holes 34*a* may be about 70 μm in the length of one side. In this way, the pitches of the head chip 21 can be narrowed as compared with that in the conventional art.

Further, according to the ink jet head 2 and the ink jet printer 1 according to this embodiment, there is provided the high-quality head chip 21 having no ejection failure which is caused by inflow of the adhesive S, and hence the high quality can be achieved, likewise. In addition, because of the head chip 21 having narrowed pitches, downsizing can be achieved while recording can be performed with high quality.

The technical scope of the present invention is not limited to the above-mentioned embodiment, and various modifications can be added without departing from the split of the present invention.

For example, in the above-mentioned embodiment, the ink jet printer 1 has been exemplified as the liquid jet device, but the liquid jet device is not limited to the printer. For example, the liquid jet device may be a facsimile device, an on-demand printing device, or the like.

Further, the configuration of the escape holes 34*a* is square, but is not limited to this configuration. The configuration of the escape holes 34*a* may be freely designed as long as the contour of the escape holes 34*a* surrounds the periphery of the nozzle openings 33*a* so as to be spaced apart from the contour of the nozzle openings 33*a* by at least the given distance H.

Further, the configuration of the nozzle openings 33*a* is not limited to circle. For example, the configuration thereof may be of a polygonal shape such as triangle, oval shape or a star shape. When the nozzle openings 33*a* are thus formed, the configuration of the escape holes 34*a* may be determined according to the configuration of the nozzle openings 33*a*.

Further, in the above-mentioned embodiment, when the nozzle plate 33 is taken in plan view, configuration is made such that the nozzle openings 33*a* and the grooves 35 do not overlap each other on a straight line. Alternatively, the nozzle openings 33*a* and the grooves 35 may overlap each other on a straight line with a reduced shift amount in the vertical width direction. That is, in this case, the intervals of the nozzle openings 33*a* arranged on two lines in parallel can be made narrower. In this case, the extended projections 34*b* formed in a part of the escape holes 34*a* are unnecessary.

In the above-mentioned embodiment, the nozzle openings 33*a* and the escape holes 34*a* are arranged in zigzag in the horizontal width direction, but the present invention is not limited to such an arrangement. That is, as long as the nozzle openings 33*a* and the escape holes 34*a* are so arranged as to be displaced from the adjacent nozzle openings 33*a* and the adjacent escape holes 34*a* in the vertical width direction, the arrangement may be freely designed. It is preferable to arrange the nozzle openings 33*a* on two lines as in the above-mentioned embodiment because the control for applying the drive voltage at the time of ejecting the ink W becomes simpler.

Further, in the above-mentioned description, the nonaqueous ink W is used. Alternatively, for example, an electrically conductive aqueous ink, a solvent ink, an oil ink, a UV ink, or the like may be used. In the case of using the aqueous ink, the head chip 21 may be configured as follows.

Figure 11:
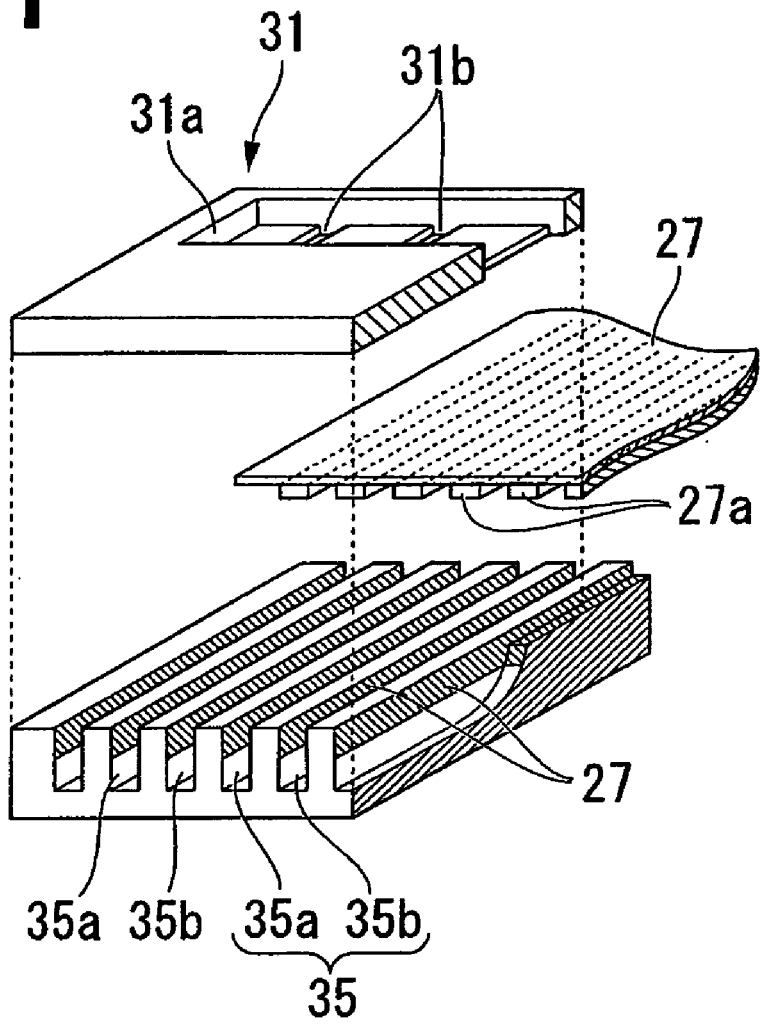
FIG. 11 is a diagram illustrating a modified example of a head chip according to the present invention, which is an exploded perspective view of the head chip when an aqueous ink is used.
Figure 12:
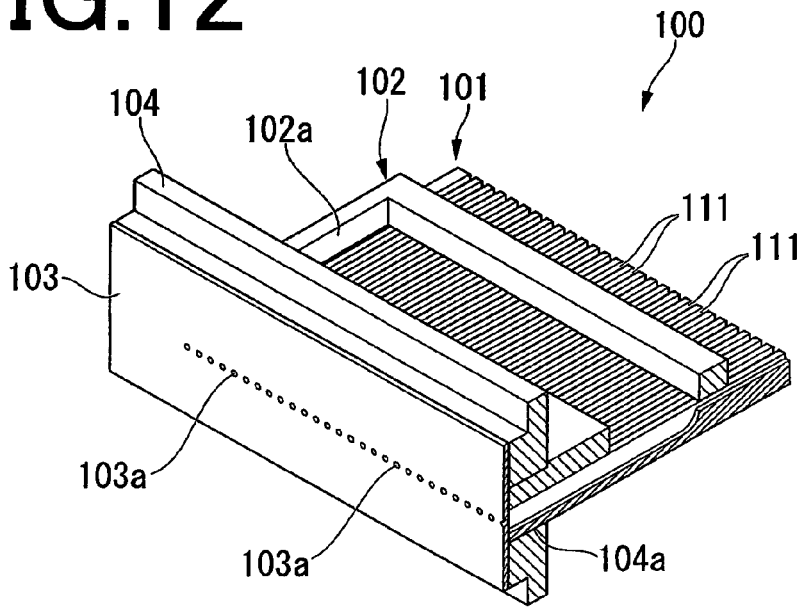
FIG. 12 is a perspective view illustrating an example of a conventional head chip.
Figure 13:
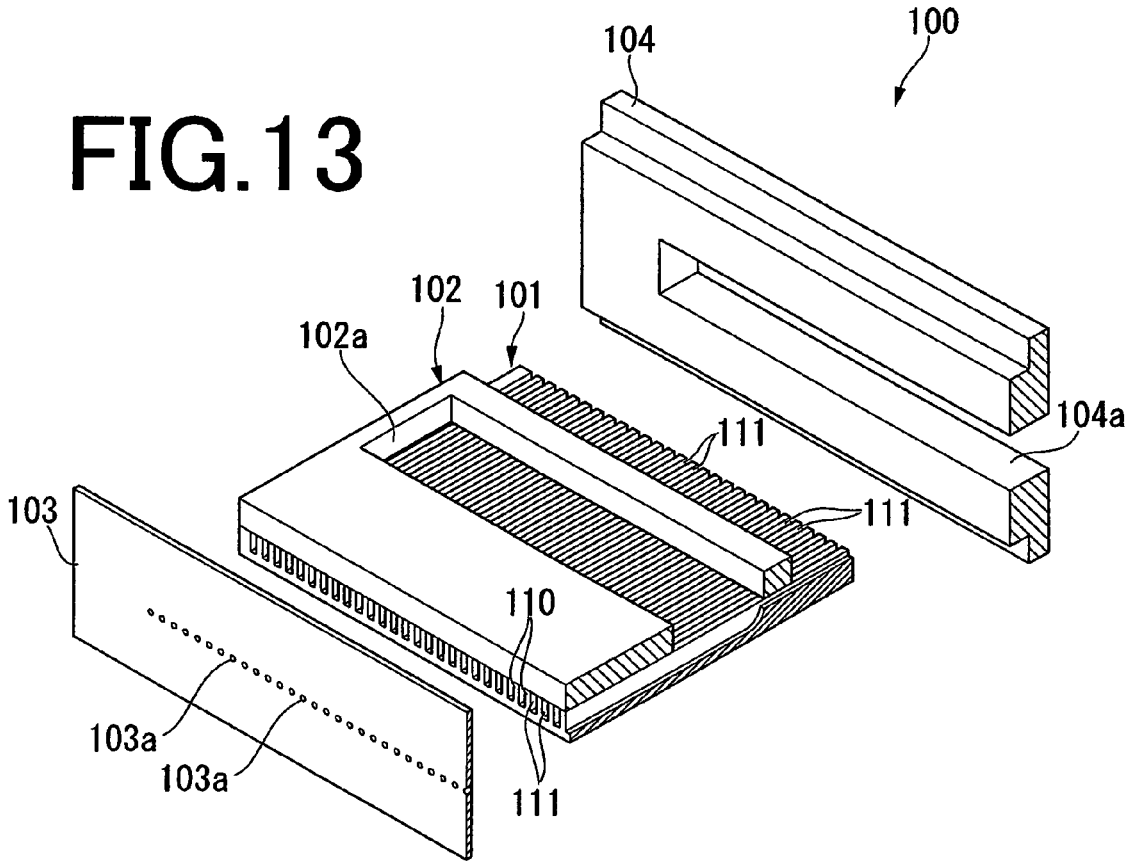
FIG. 13 is an exploded perspective view of the head chip illustrated in FIG. 12.
Figure 14:
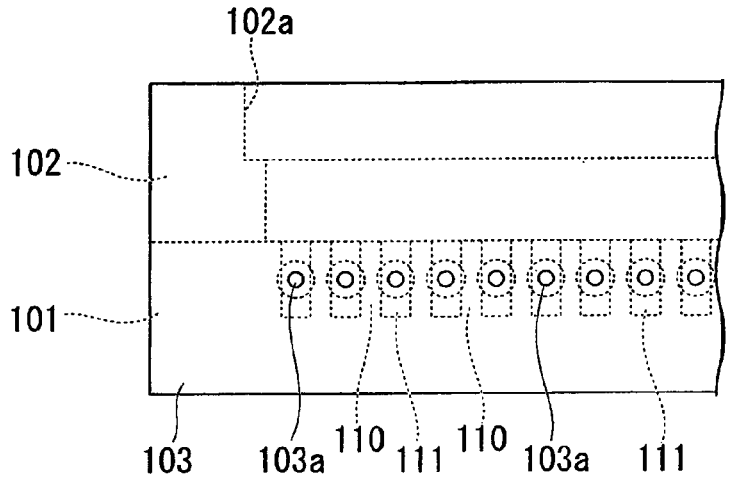
FIG. 14 is a view of the head chip illustrated in FIG. 12 viewed from a nozzle plate side.
Figure 15:
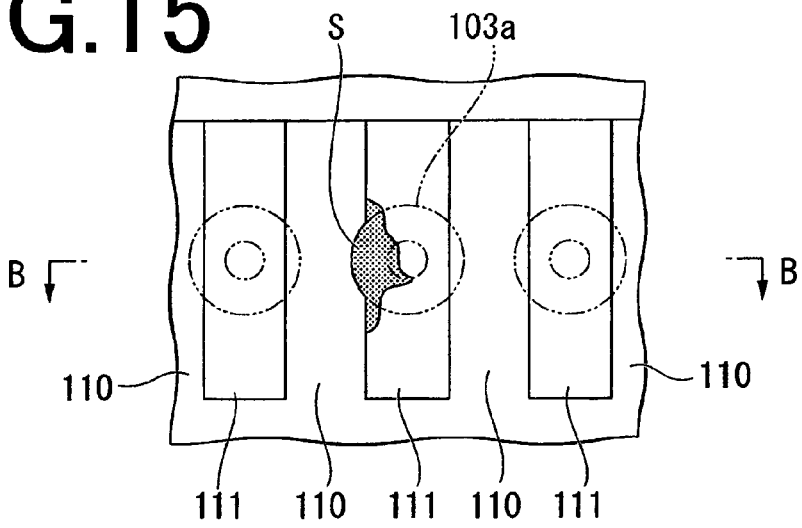
FIG. 15 is an enlarged view of a nozzle opening periphery illustrated in FIG. 14.
Figure 16:
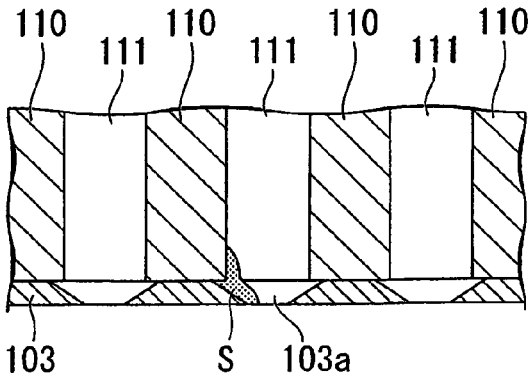
FIG. 16 is a cross-sectional view taken along a line B-B of FIG. 15.

That is, as illustrated in FIG. 11, the plurality of grooves 35 are alternately used as the grooves 35*a* that function as the ejection channels that are filled with the ink W, and the grooves 35*b* that function as the dummy channels that are not filled with the ink W. The ink introduction aperture 31*a* is formed with slits 31*b* that introduce the supplied ink W into the grooves 35*a* that function as the ejection channels. That is, the slits 31*b* are formed at positions facing the grooves 35*a* that function as the ejection channels. With the above-mentioned configuration, only the grooves 35*a* that function as the ejection channels can be filled with the ink W. Then, the escape holes 33*a* and the nozzle openings 34*a* are so formed as to face the grooves 35*a* that function as the ejection channels.

With the head chip 21 thus configured, even with the use of the aqueous ink W, the drive electrodes 37 disposed in the grooves 35*a* that function as the ejection channels, and the drive electrodes 37 disposed in the grooves 35*b* that function as the dummy channels can be selectively used so as to be electrically isolated from each other without being rendered conductive through the ink W. Accordingly, recording can be performed by using the aqueous ink W.

In particular, the ink W having the electrical conductivity can be used without any problem, and hence the added value of the ink jet printer 1 can be enhanced. Other configurations can provide the same advantageous operations and effects.

What is claimed is:

1. A head chip for ejecting liquid toward a recording medium, comprising:

an actuator plate having a plurality of grooves to be filled with the liquid, formed at given intervals in a horizontal width direction;

a drive electrode which is formed on each side wall of each of the plurality of grooves, increases pressure within each of the plurality of grooves by deforming the side wall when a drive voltage is applied to the drive electrode, and causes the filled liquid to be ejected from an inside of each of the plurality of grooves;

a cover plate which is stacked on the actuator plate, and has an introduction aperture from which the liquid is introduced into the plurality of grooves;

a nozzle plate which is fixed to an end surface of the actuator plate through an adhesive, and has a plurality of nozzle openings formed at the same intervals as intervals of the plurality of grooves in the horizontal width direction; and a number of escape holes which are formed between the nozzle plate and the actuator plate and allow the plurality of nozzle openings and the plurality of grooves to communicate with each other, the number corresponding to a number of the plurality of nozzle openings, wherein each of the plurality of escape holes has a contour which surrounds a periphery of each of the plurality of nozzle openings with the contour being spaced apart from a contour of each of the plurality of nozzle openings by at least a given distance, wherein the adhesive remaining at a time of fixing the nozzle plate is accumulated in the plurality of escape holes, and wherein the plurality of nozzle openings and the plurality of escape holes are so arranged as to be displaced from adjacent nozzle openings and adjacent escape holes by a given distance in a vertical width direction of the nozzle plate, which is orthogonal to the horizontal width direction.

2. A head chip according to claim 1, wherein the plurality of nozzle openings and the plurality of escape holes are arranged in zigzag in the horizontal width direction so as to be arranged on two lines in parallel at the given distance.

3. A head chip according to claim 1, wherein each of the plurality of nozzle openings is an opening having the contour forming a circle.

4. A head chip according to claim 1, wherein each of the plurality of escape holes is formed into a square having a center that is substantially coincident with a center of each of the plurality of nozzle openings.

5. A head chip according to claim 1, wherein the plurality of escape holes are formed in an adhesion plate that is interposed between the nozzle plate and the actuator plate, and fixed to both of the nozzle plate and the actuator plate through the adhesive.

6. A head chip according to claim 1, wherein the plurality of grooves have a part that functions as ejection channels which are filled with the liquid and a part that functions as dummy channels which are filled with no liquid, the part that functions as the ejection channels and the part that functions as the dummy channels being alternately arranged, wherein the introduction aperture is formed with slits that introduce the liquid into only grooves in the part that functions as the ejection channels, and wherein the plurality of nozzle openings are so formed as to communicate with only grooves in the part that functions as the ejection channels.

7. A liquid jet head, comprising:

the head chip according to claim 1;

supply means for supplying a given amount of the liquid to the introduction aperture; and control means for applying the drive voltage to the drive electrode.

8. A liquid jet device, comprising:

the liquid jet head according to claim 7;

conveying means for conveying the recording medium in a predetermined direction; and moving means for reciprocating the liquid jet head in a direction orthogonal to the predetermined direction in which the recording medium is conveyed.

* * * * *